US005706723A

United States Patent [19]

Ohno

[11] Patent Number: 5,706,723

[45] Date of Patent: Jan. 13, 1998

[54] APPARATUS FOR CONTROLLING NOZZLE MOVEMENT IN NOZZLE-TYPE DAMPENING SYSTEMS

[75] Inventor: Kinichiro Ohno, Machida, Japan

[73] Assignee: Tokyo Kikai Seisakusho, Ltd., Tokyo, Japan

[21] Appl. No.: 749,204

[22] Filed: Nov. 14, 1996

[30] Foreign Application Priority Data

Nov. 20, 1995 [JP] Japan ..... 7-300817

[51] Int. Cl.[6] ..... B41F 7/30; B41L 25/06

[52] U.S. Cl. ..... 101/148

[58] Field of Search ..... 101/147, 148, 101/366; 118/697, 698, 695, 696, 259, 300, 319, 305

[56] References Cited

U.S. PATENT DOCUMENTS 5,463,951 11/1995 Waizmann et al. ..... 101/433

OTHER PUBLICATIONS

May 24, 1976 Japanese Published Unexamined Patent Application No. Sho-51(1976)-59511 No translation.

Apr. 26, 1989 Japanese Published Unexamined Patent Application No. Hei-1(1989j-110146 No translation.

Dec. 14, 1993 Japanese Published Unexamined Patent Application No. Hei-5(1993)-330009 No translation.

*Primary Examiner*—J. Reed Fisher

*Attorney, Agent, or Firm*—McGlew and Tuttle

[57] ABSTRACT

A dampening system for planographic printing presses having a roller means for feeding dampening solution injected by a nozzle means onto the surface of a plate cylinder comprises a motor for moving the nozzle means, a nozzle position signal output means for outputting the present position of the nozzle means, a moving position setting means for setting moving position to which the nozzle means is to be moved, and a data select signal output means for outputting an access signal in accordance with the operating speed of the printing press, and controls the distance between the roller means and the nozzle means in accordance with the operating speed of the printing press.

7 Claims, 4 Drawing Sheets

APPARATUS FOR CONTROLLING NOZZLE MOVEMENT IN NOZZLE-TYPE DAMPENING SYSTEMS

BACKGROUND OF THE INVENTION

1. Field of the Invention

This invention relates generally to an apparatus for controlling nozzle movement in nozzle-type dampening systems, and more specifically to an apparatus for controlling nozzle movement in nozzle-type dampening systems for planographic presses which carries out control so that nozzles for injecting dampening solution are caused to move close to and away from an opposing roller in accordance with the operating speed of the printing press.

2. Description of the Prior Art

Planographic printing uses a printing plate having practically no irregularities and consisting of a lipophilic printing area and a hydrophilic non-printing area to achieve printing by feeding dampening solution principally composed of water and oily ink onto the plate surface so that ink is fed selectively on the printing area alone using the mutual repellency of water and oil. The mechanism used as a dampening system for feeding dampening solution can be roughly divided into the following two types.

One type is such that a roller train is provided in a space between the reservoir of dampening solution and the printing plate surface, and the dampening solution is drawn by the peripheral surface of a rotating roller, part of which is immersed in the dampening solution in the dampening solution reservoir, and fed to the printing plate surface through the contact of the circumferential surfaces of the adjoining rollers, and thereby applied to the printing plate surface.

This type can feed the dampening solution in such a manner as to evenly form a film over the entire axial surface of the roller. It is difficult, however, to change the feed of the dampening solution on each axial portion of the roller. In addition, ink may enter into the dampening solution reservoir from the printing plate surface via the roller train, contaminating the dampening solution.

Another type is such that the inconvenience encountered with the former type is overcome by providing a source of dampening solution separately from the printing plate or the roller train extending to the printing plate surface, and the dampening solution is fed by spraying the dampening solution onto the printing plate surface or the roller train leading to the printing plate surface, so that the feed of the dampening solution onto each axial portion of the roller can be changed. This type of dampening system includes prior-art nozzle-type dampening systems that sprays dampening solution through nozzles, such as Japanese Published Unexamined Patent Application No. Sho-51(1-976)-59511, Japanese Published Unexamined Patent Application No. Hei-1(1989)-110146, and Japanese Published Unexamined Patent Application No. Hei-5(1993)-330009.

Japanese Published Unexamined Patent Application No. Sho-51(1976)-59511 discloses a dampening system that feeds dampening solution to each of a plurality of nozzles at a constant rate by regulating the feed of the dampening solution by a metering pump, and at the same time feeds air by a blower to produce a rapid air stream to cause the dampening solution to be sprayed as an atomized mist. In this dampening system, the operation of a drive motor is controlled so that the metering pump can be operated at a desirable rate corresponding to the speed of the printing press.

Japanese Published Unexamined Patent Application No. Hei-1(1988)-110146 discloses a dampening system having a pump unit for feeding dampening solution, nozzles for spraying the dampening solution fed by the pump unit, and a control unit for controlling the injection rate of dampening solution from the nozzles in accordance with the printing speed of the printing press. The injection rate of dampening solution is controlled by calculating the timing at which dampening solution is injected by correlating it with the revolution of the printing plate of the printing press, based on the preset and stored reference value, the adjustment value entered in accordance with the printing image corresponding to each injection nozzle, and the correction value preset and stored for each printing speed of the printing press, and by opening the nozzles for a predetermined time for each timing obtained. That is, control is carried out so that the constant injection of the dampening solution is maintained as the plate cylinder of the printing press revolves by the value obtained above.

Japanese Published Unexamined Patent Application No. Hei-1(1989)-110146 states that in addition to the above-mentioned control, the injection of dampening solution can be controlled by changing the solution injection time, that is, the nozzle opening time or the injection pressure, and that the injection of dampening solution can be controlled by changing the opening area of a shutter member provided in front of the nozzle, though it does not disclose details.

Japanese Published Unexamined Patent Application No. Hei-5(1993)-330009 discloses a dampening system comprising a speed detecting means for detecting the printing speed of the printing press, a memory in which the feed of dampening solution to be fed in accordance with printing conditions and the printing speed of the printing press, an injecting means having a plurality of nozzles and connected to the dampening solution source and the air source via piping for continuously injecting a mist of dampening solution toward the printing plate or the circumferential surface of a roller coming in contact with the printing plate by the aid of a rapid air stream, and a pressure control means provided in between piping connecting the dampening solution source to the injecting means for controlling the supply pressure of the dampening solution to the injecting means in accordance with the feed of the dampening solution stored in the memory.

In the dampening system disclosed in Japanese Published Unexamined Patent Application No. Hei-5(1993)-330009, the injection of dampening solution is controlled in such a manner that the feed of the dampening solution is set in accordance with printing conditions, such as printing speed, humidity and temperature, and the pressure of the dampening solution discharged to the downstream side of the pressure control means is kept constant by comparing the set feed of the dampening solution with the pressure value in the piping on the downstream side of the pressure control means. Furthermore, it is stated in Japanese Published Unexamined Patent Application No. Hei-5(1993)-330009 that a needle valve is provided on the upstream side of each nozzle to fine adjust the feed of the dampening solution, and thereby the dampening solution constant feed performance can be improved.

Generally speaking, the amount of fluid sprayed through a nozzle is not uniform over the entire fluid spray range, and usually tends to become smaller in the surrounding area of the spray range. In the prior-art nozzle-type dampening system for printing presses as described above, therefore, nozzles are provided by appropriately setting the intervals of the adjoining nozzles and the distance between the nozzles and the printing plate so that the spraying patterns of the dampening solution injected through the adjoining nozzles slightly overlaps in the across-the-width direction of the printing plate to which the dampening solution is injected, or in the axial direction of the roller to supplement the adjoining solution-deficient areas.

It was revealed, however, from the results of various printing tests using such nozzle-type dampening systems that as printing speed is increased, troubles due to excessive dampening solution tend to occur on the printing surface areas corresponding to the overlapped dampening solution spraying areas for unknown reasons even when the feed of the dampening solution is controlled in accordance with printing conditions, and that the above troubles can be overcome by changing the distance between the nozzles and the printing plate to change the size of the overlapped spraying pattern of the dampening solution injected through the nozzles.

SUMMARY OF THE INVENTION

It is an object of this invention to provide an apparatus for controlling nozzle movement in a nozzle-type dampening system in which the distance between the nozzle and the printing plate is controlled at an appropriate value in accordance with printing speed, that is, the operating speed of the printing press.

DETAILED DESCRIPTION OF THE EMBODIMENTS

Figure 1:
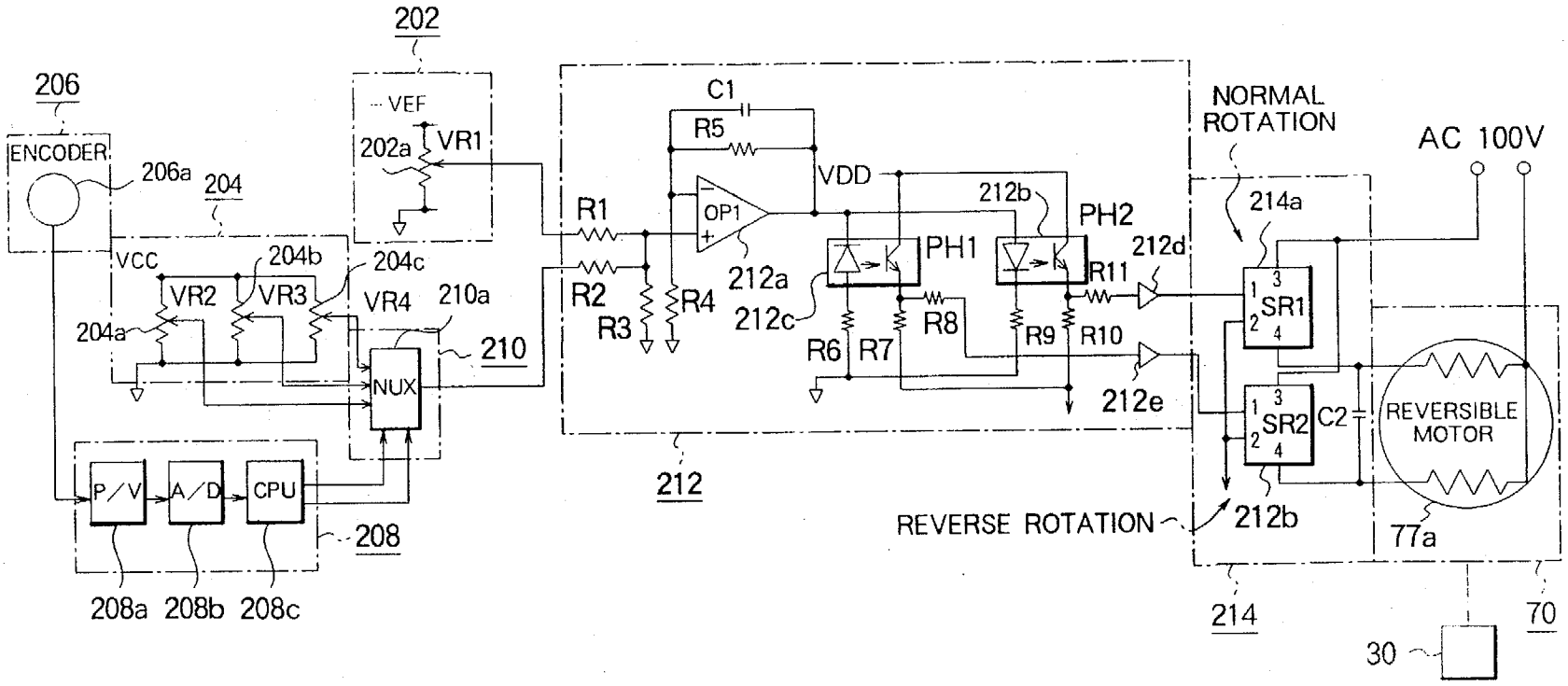
FIG. 1 shows the construction of an apparatus for controlling nozzle movement for nozzle-type dampening systems embodying this invention.

Prior to the description of the apparatus for controlling nozzle movement for nozzle-type dampening systems embodying this invention, as shown in FIG. 1, an offset printing press to which this invention shown in FIGS. 2 through 5 is applied will be described.

In the figure, reference numeral 1 refers to a dampening system, 10 to a roller means, 30 to a nozzle means, 50 to a dampening solution feeding means, 70 to a nozzle moving means, 80 to a cover, 100 to a nozzle operation control means, 200 to a nozzle means movement control device, respectively.

Symbol IN refers to an ink arrangement, PC to a plate cylinder, BC to a blanket cylinder, and IC to an impression cylinder, respectively.

In a planographic press having the dampening device 1 shown in FIG. 1, a printing plate (not shown) having a lipophilic printing area and a hydrophilic non-printing area is fitted to the plate cylinder PC, onto the surface of which an appropriate amount of ink is fed by the ink device IN (the upstream side thereof is not shown in FIG. 2), and an appropriate amount of dampening solution is fed by the dampening device 1.

As a result, ink is deposited only on the printing area due partly to the conflicting properties of the picture area and non-picture area of the printing plate surface, and partly to the mutual repulsion between the dampening solution chiefly consisting of water and the oily ink. Thus, an image is printed on the web W passed between the blanket cylinder BC and the impression cylinder IC via a blanket (not shown) fitted to the blanket cylinder BC.

The dampening device 1 has a roller means 10 having a contact area to the printing plate, a nozzle means 30 for injecting the dampening solution toward a predetermined area of the roller means 10, and a dampening solution feeding means 50 for feeding the dampening solution to the nozzle means 30.

The roller means 10 has such a construction that a downstream roller 11 that rotates in contact with the printing plate is provided in parallel with an upstream roller 12 that rotates in contact with the downstream roller 11 and serves as a solution receiving roller for receiving the dampening solution injected through the nozzle means 30.

Although the roller means 10 shown in the figure comprises two rollers, that is, the downstream and upstream rollers 11 and 12, there can be different constructions where the upstream roller alone comes in contact with the printing plate with the downstream roller 11 removed, or another rider roller or intermediate roller is added. Furthermore, there can be a construction where the dampening solution is received by the outer circumferential surfaces of a plurality of rollers in the vicinity of the contact area of the adjoining rollers. In other words, the solution receiving roller is not limited to a single roller.

The nozzle means 30 has a pipe member 31 provided virtually in parallel with the axis of the upstream roller 12, and a plurality of (eight in the embodiment shown in the figure) nozzles 32 provided at almost equal intervals on the pipe member 31; both longitudinal sides of the nozzle means 30 are fitted to a frame (F in FIG. 3) via a nozzle moving means 70, which will be described in detail later, referring to FIGS. 3 and 4; and the dampening solution is fed in pressurized state to the pipe member 31 from a dampening solution feeding means 50.

Figure 5:
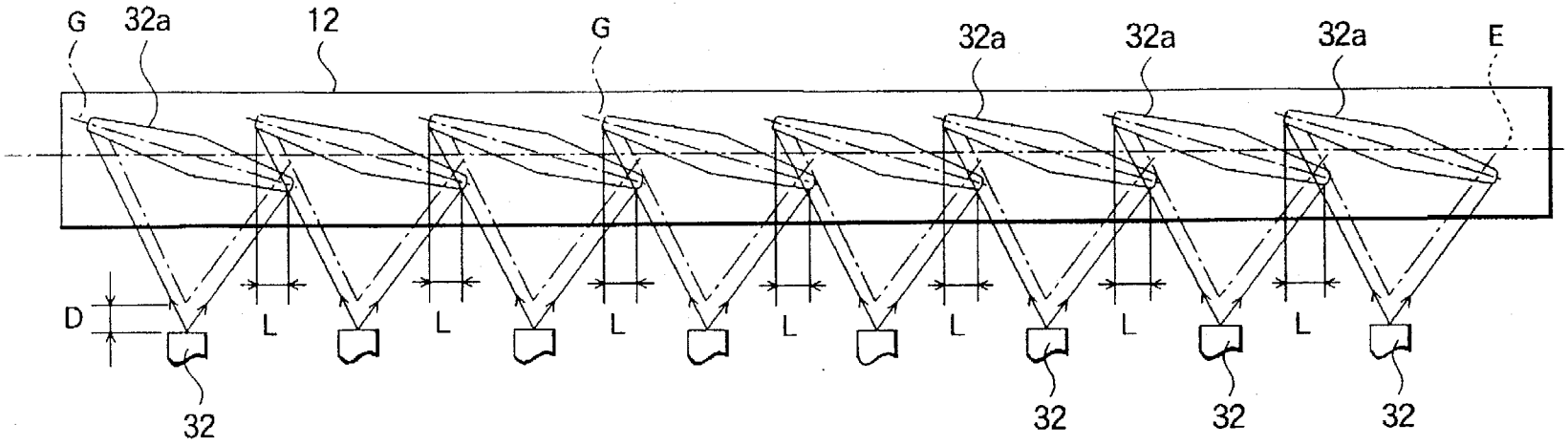
FIG. 5 is a diagram of assistance in explaining the spraying patterns of the dampening solution sprayed through the nozzles of the dampening system on the periphery surface of an upstream roller.

The nozzle moving means 70 is used to adjust the overlap L in the axial direction of the upstream roller 12 of the dampening solution spraying pattern 32*a* on the periphery of the upstream roller 12 shown in FIG. 5 by moving the nozzles 32 away from or close to the periphery of the upstream roller 12.

Each of the nozzles 32 has a spout for injecting the dampening solution in an oval-shaped pattern onto the outer periphery of the upstream roller 12, as shown by the dampening solution spraying pattern 32*a* in FIG. 5, and is provided on the pipe member 31, with the intake port of the dampening solution being opened toward the pipe member 31 and the spout directed toward the outer periphery of the upstream roller 12. The nozzle 32 is disposed in such an attitude that the longitudinal axes of the oval-shaped dampening solution spraying patterns 32*a* on the outer periphery of the upstream roller 12 are inclined with respect to the axis of the upstream roller 12 and are parallel with each other.

The nozzle means 30 has a cover 80 for preventing the dampening solution injected through the nozzles 32 from being splashed and for recovering excess dampening solution.

The cover 80 comprises a cylindrical inner cover 81 having at the upper and lower ends rectangular openings that extend in the axial direction of the upstream roller 12, and a rectangular trough-shaped outer cover 82 that fits to the lower part of the inner cover 81 from the outside to close the lower opening of the inner cover 81 and is vertically movable with respect to the inner cover 81 in the state where the outer cover 82 is fitted to the inner cover 81. The inner cover 81 is fitted to a frame F (refer to FIG. 3) via a first block member 71 of the nozzle moving means 70, which will be described later, while the outer cover 82 is fitted to a second block member 72 of the nozzle moving means (refer to FIG. 3) in such a manner as to be movable as the second block member 72 is moved.

Furthermore, a discharge port for discharging the recovered excess dampening solution is provided on the outer cover 82, and the contact area between the outer cover 82 and the nozzle means 30 is made watertight.

The edge of the upper opening of the inner cover 81 is provided at minute intervals in close proximity to the lower outer periphery of the upstream roller 12.

The nozzle 32 has a solenoid valve mechanism for opening the spout with the excitation of a solenoid, and closing the spout by the resiliency of a spring as the solenoid is deenergized in accordance with the control of a nozzle operation control means 100, which will be described later.

The dampening solution feeding means 50 has a dampening solution tank 51, a conduit 52 for connecting the dampening solution tank 51 to the pipe member 31, and a pump 53 disposed in the conduit 52, and a pressure regulator 54 is provided as necessary on the downstream side of the pump 53 in the conduit 52.

The conduit 52 is made of a flexible pipe material, for example, at least in the vicinity of the portion thereof connecting to the pipe member 31 so as to permit the conduit 52 to follow the movement of the nozzle means 30 due to the operation of the nozzle moving means 70, which will be described later.

The nozzle operation control means 100 is adapted so that a pulse signal is input to the nozzle operation control means 100 from a rotary encoder 206*a* of an operating pulse output means 206 that is used in common by the nozzle operation control means 100 and the nozzle means movement control device 200, which will be described in detail in FIG. 1, counts the number of the pulse signals, outputs an excitation current to the solenoid of the nozzle 32 every time the pulse signal count reaches a predetermined value, and continues to output the excitation current for a predetermined time in accordance with the count in a predetermined time, that is, printing speed. The nozzle operation control means 100 has a solenoid driver and a CPU, for example. The output of excitation current to the solenoids of the nozzles 32 arranged at equal intervals in a line is controlled for each nozzle 32.

Next, the nozzle moving means 70 for supporting the nozzle means 30 in such a manner as to change the position of the nozzle means 30 with respect to the frame F will be described in reference to FIGS. 3 and 4.

Figure 2:
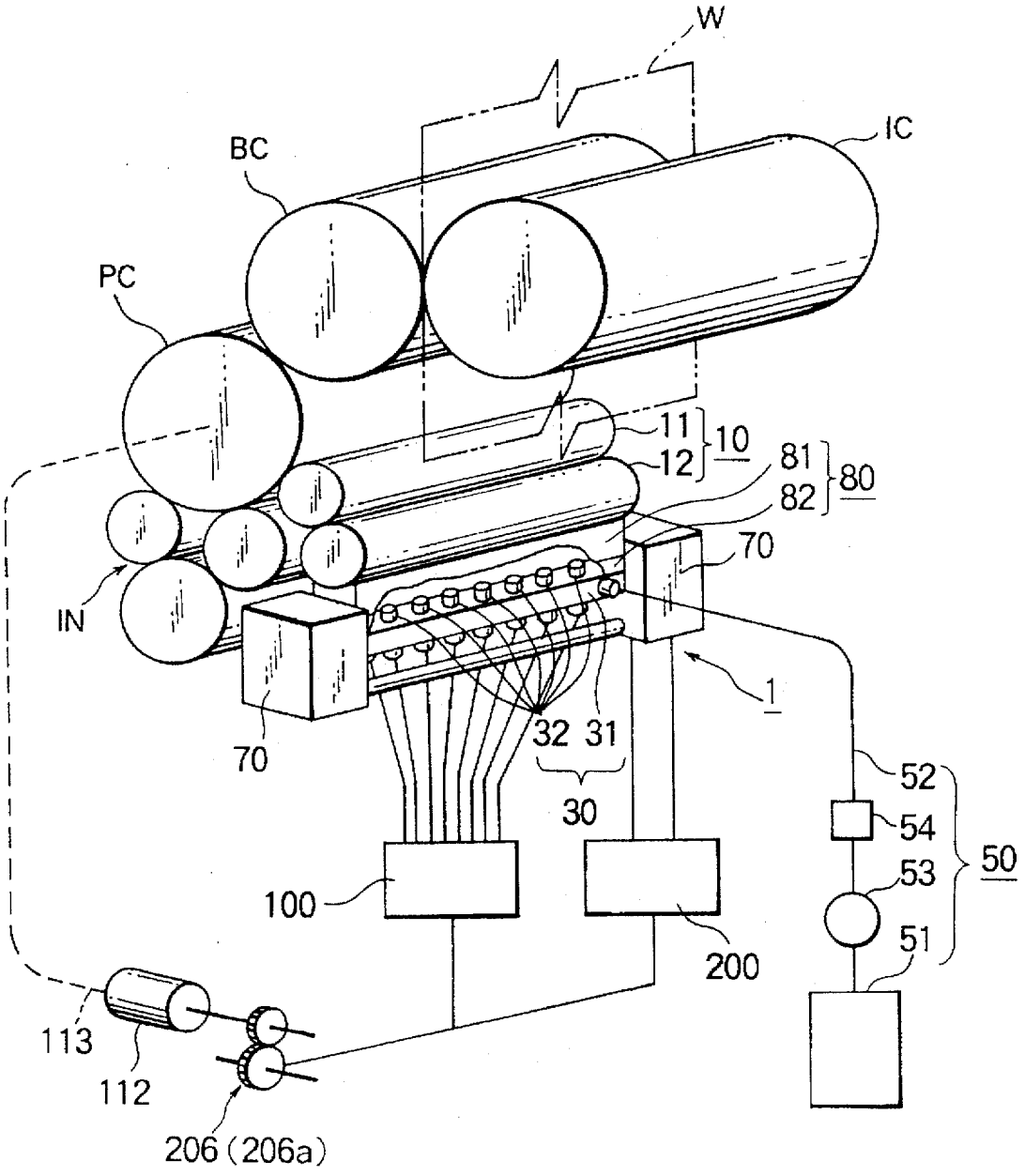
FIG. 2 is a perspective view of assistance in explaining the outlined construction of a planographic press having a nozzle-type dampening system.
Figure 3:
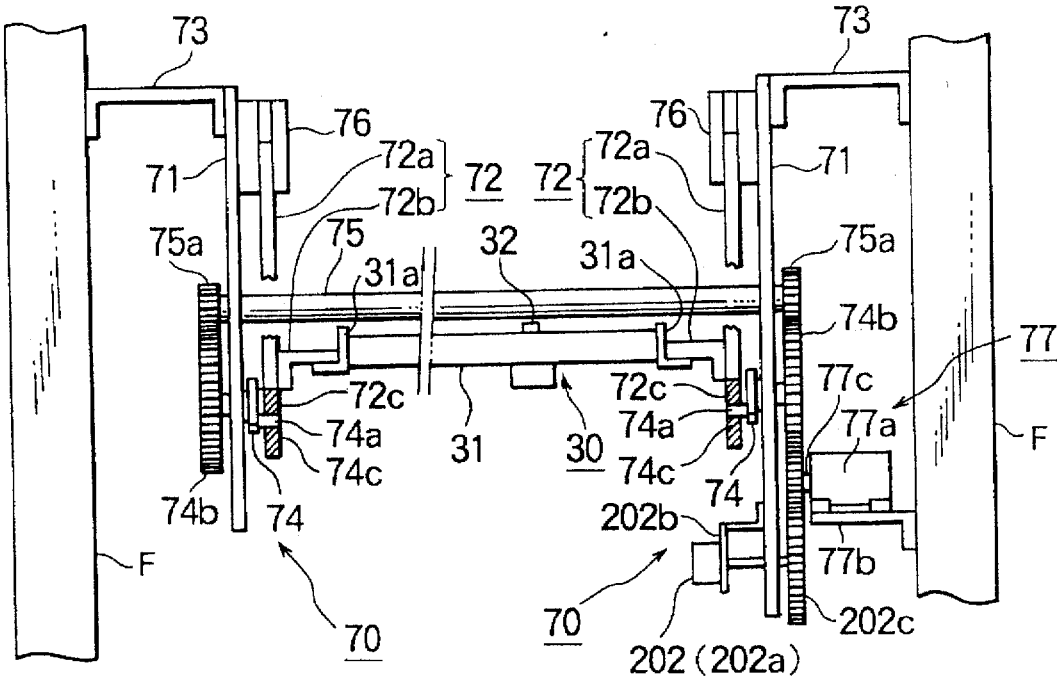
FIG. 3 is a diagram of assistance in explaining the construction of a nozzle moving means embodying this invention.
Figure 4:
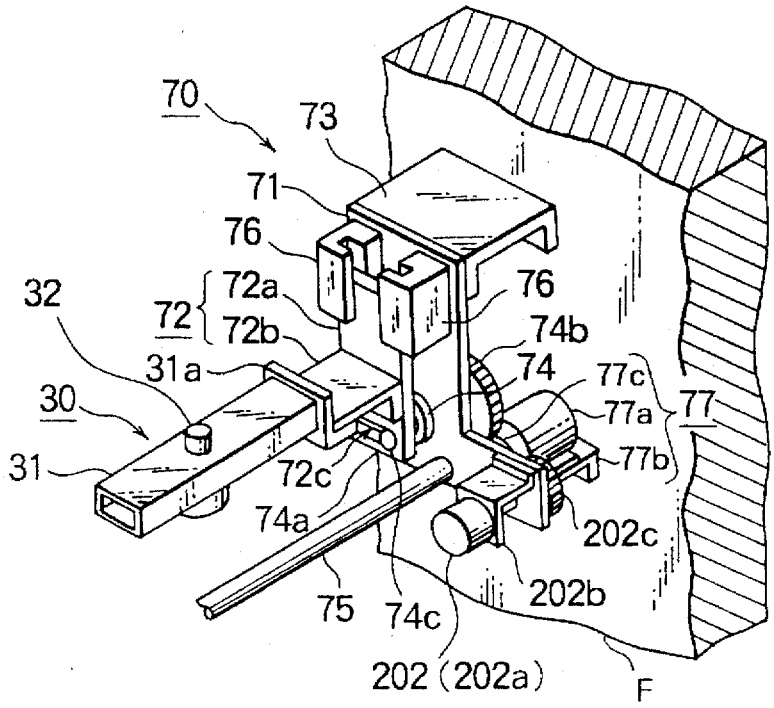
FIG. 4 is a partial perspective view of one end of the nozzle moving means shown in FIG. 3.

In FIGS. 3 and 4, a first block member 71 is disposed on the frame F via a bracket 73 in such a manner as to face another first block member disposed on the other side of the frame F on an axial line parallel with the axial line of the upstream roller 12 (refer to FIG. 2).

On the lower part of the downwardly extending first block member 71 rotatably provided are gear shaft 74 facing each other on an axial line parallel with the axial line of the upstream roller 12. Offset shafts 74*a* facing each other are provided on the inside end faces of the opposing gear shafts 74. On the outside ends of the opposing gear shafts 74 provided are gears 74*b*. Rollers 74*c* are rotatably fitted to the offset shafts 74*a*.

Both ends of a through shaft 75 parallel with the axial line of the gear shafts 74 are rotatably supported on the lower part of the first block members 71, and gears 75*a* in mesh with the gears 74*b* are provided on both external ends of the through shaft 75.

A potentiometer 202*a* as a nozzle position signal output means 202 of the nozzle means movement control means 200 for controlling the operation of the nozzle moving means 70 is installed on the lower part of any one of the first block member 71 via a bracket 202*b*. A gear 202*c* is installed on the operating shaft of the potentiometer 202*a*.

On the other hand, a pair of guide members 76 are installed on each of the upper inside side surfaces of the first block members 71, and second block members 72 also are vertically movably installed on the inside side surfaces of the first block members 71, with each of the upper parts of the upwardly extending proximal parts thereof sandwiched by a pair of the guide members.

The second block member 72 comprises the aforementioned proximal part 72*a* and a cantilevered part 72*b* disposed at right angles with said proximal part 72*a*. A slotted hole 72*c* is provided at the lower part of the proximal part 72*a*, and a roller 74*c* fitted to an offset shaft 74*a* of the gear shaft 74 is engaged with the slotted hole 72*c* in such a manner as to be movable along with the slotted hole 72*c*.

The cantilevered parts 72*b* of the second block members 72 are provided facing each other on the axial line parallel with the axial line of the upstream roller 12. At the tips of the cantilevered parts 72*b* provided are closing members 31*a* that close both ends of the pipe member 31 of the nozzle means 30. Consequently, the pipe member 31 is supported by the second block members 72 with both ends thereof fitted to the second block members 72 via the closing members 31*a*.

On another frame F provided is a reversible motor 77*a* that is a drive source 77 of the nozzle moving means 70 via a drive source bracket 77*b* at the lower part of the first block member 71. On an output shaft of the reversible motor 77*a* provided is a gear 77*c* that is in mesh with a gear 74*b* fitted to the gear shaft 74 and a gear 202*c* fitted to an operating shaft of the potentiometer 202*a*.

The reversible motor 77*a* is controlled and operated by the nozzle means movement control device 200, as described earlier.

The inner cover 81 constituting the cover 80 is fitted to the first block members 71 via the guide members 76, and the outer cover 82 is fitted to the second block members 72 via the cantilevered part 72*b* or the proximal part 72*a*. With this arrangement, the cover 80 expands or contracts in accordance with the movement of the nozzle means 30.

Next, the nozzle means movement control device 200 will be described, referring to FIG. 1.

The nozzle means movement control device 200 comprises a nozzle position signal output means 202 for detecting the present position of the nozzle means with respect to a reference position, a moving position setting means 204 for determining moving steps of the nozzle means 30, an operating pulse output means 206 for outputting pulses in synchronism with the rotation of the plate cylinder PC used in common with the nozzle operation control means 100, as described with reference to FIG. 2, a data select signal output means 208 for outputting a data select signal in accordance with the operating speed of the printing press, a nozzle movement signal output means 210 for outputting a nozzle movement signal, an operating signal output means 212 for outputting an operating signal for the reversible motor 77*a*, and a switch means 214 for selecting the normal or reverse operation of the reversible motor 77*a*.

The nozzle position signal output means 202 comprises a potentiometer 202*a* for detecting the present position of the nozzle means 30 that moves away from and close to the roller means 10 with respect to a predetermined reference position.

The moving position setting means 204 comprises a plurality of (three in the figure) potentiometers 204*a*, 204*b* and 204*c*, and sets the moving positions, with respect to a predetermined reference position, of the moving steps of the nozzle means 30 that moves away from and close to the roller means 10 as voltage values opposite in polarity to the nozzle position signals.

The operating pulse output means 206 comprises a rotary encoder 206*a*, and outputs the operating state of the printing press from the rotary encoder 206*a* as pulse signals in synchronism with the rotation of the plate cylinder PC.

The data select signal output means 208 comprises an F/V converter 208*a*, an A/D converter 208*b* and a CPU 208*c*, detects the operating speed of the printing press based on the pulse signals that synchronize with the rotation of the plate cylinder PC produced from the operating pulse output means 206, and outputs data select signals in accordance with the detected operation speed.

The nozzle movement signal output means 210 comprises an analog multiplexer 210*a*, selects an appropriate voltage value from among predetermined voltage values in the potentiometers 204*a*, 204*b* and 204*c* of the moving position setting means 204 on the basis of the data select signal output from the data select signal output means 208, and outputs the selected voltage value as a nozzle movement signal.

The operating signal output means 212 comprises an operational amplifier 212*a*, photocouplers 212*b* and 212*c*, and buffers 212*d* and 212*e*, and outputs operating signals to cause the reversible motor 77*a* to rotate in normal or reverse rotation on the basis of the sum of voltage values representing the nozzle position detecting signals from the nozzle position signal output means 202 and the nozzle movement signals from the nozzle movement signal output means 210.

The switch means 214 comprises solid-state relays 214*a* and 214*b*, and is provided between a motor power source and the reversible motor 77*a* to switch the normal and reverse rotation of the reversible motor 77*a* in accordance with the operating signals from the operating signal output means 212.

The nozzle means movement control device 200 having the aforementioned construction operates in the following manner in accordance with the operating state of the printing press.

First, prior to, or at an appropriate timing after the operation of the printing press, the potentiometers 204*a*, 204*b* and 204*c* of the moving position setting means 204 are operated to set voltage values at which a plurality of desired positions can be obtained with respect to the reference position of the nozzle means 30 (the remotest position from the roller means 10). In FIG. 1, a positive voltage value is set.

As the printing press is operated, the potentiometer 202*a* of the nozzle position signal output means 202 outputs a nozzle position signal, which is a negative voltage value representing the present position of the nozzle means 30 with respect to the reference position. When the nozzle means 30 is at the reference position, the voltage value as the nozzle position signal output by the potentiometer 202*a* is zero.

Furthermore, as the printing press is operated, the rotary encoder 206*a* of the operating pulse output means 206 outputs pulse signals that synchronize with the rotation of the plate cylinder PC.

The pulse signal is processed by the F/V converter 208*a*, the A/D converter 208*b* and the CPU 208*c* of the data select signal output means 208. That is, the data select signal output means 208 calculates the operating speed of the printing press, and outputs a data select signal based on the calculated operating speed. The data select signal assumes different values for stages; 0 copies/hour<X<50,000 copies/hour (1st stage), 50,000 copies/hour≦X<100,000 copies/hour (2nd stage), and 100,000 copies/hour≦X<150,000 copies/hour (3rd stage) where X is the operating speed of the printing press.

The data select signals are input into the analog multiplexer 210*a* of the nozzle movement signal output means 210. On the other hand, the positive voltage values set by the potentiometers 204*a*, 204*b* and 204*c* of the moving position setting means 204 are input into the analog multiplexer 210*a*.

The analog multiplexer 210*a* of the nozzle movement signal output means 210 selects appropriate voltage values corresponding to the data select signals from among the positive voltage values set by the potentiometers 204*a*, 204*b* and 204*c*, and outputs as the nozzle movement signals. That is, when the operating speed of the printing press is at the first stage, data select signals corresponding to the first stage are input into the analog multiplexer 210*a*, and the analog multiplexer 210*a* selects the positive voltage values set by the potentiometer 204*a* in accordance with the data select signals, and outputs the positive voltage values as the nozzle movement signals. When the operating speed of the printing press is at the second stage, data select signals corresponding to the second stage are input into the analog multiplexer 210*a*, and the analog multiplexer 210*a* selects the positive voltage values set by the potentiometer 204*b* to output as the nozzle movement signal. When the operating speed of the printing press is at the third stage, data select signals corresponding to the third stage are input into the analog multiplexer 210*a*, and the analog multiplexer 210*a* selects the positive voltage values set by the potentiometer 204*c* to output as the nozzle movement signals.

The aforementioned nozzle movement signals are added to the negative voltage values of the nozzle position signals output by the potentiometer 202*a* of the nozzle position signal output means 202, and the voltage value as the sum thereof is input into the operational amplifier 212*a* of the operating signal output means 212. The operational amplifier 212*a* amplifies the voltage value, and drives the photocoupler 212*b* or 212*c*. That is, when the sum of the nozzle movement signal and the nozzle position signal is a positive voltage value, the output of the operational amplifier 212*a* becomes a positive voltage value, driving the photocoupler 212*b*, and the buffer 212*d* turns the output into an H level. When the sum of the nozzle movement signal and the nozzle position signal is a negative voltage value, the output of the operational amplifier 212*a* becomes a negative voltage value, driving the photocoupler 212*c*, and the buffer 212*e* turns the output into an H level. The signal obtained as the photocoupler 212b is driven and the output thereof is output at an H level by the buffer 212d, or the signal obtained as the photocoupler 212c is driven and the output thereof is output at an H level by the buffer 212e, is an operating signal output by the operating signal output means 212. The light-emitting diodes of the photocouplers 212b and 212c serve as the insensitive zone of the operational amplifier 212a, preventing the photocouplers 212b and 212c from being driven simultaneously.

The operating signal is input into the solid-state relay 214a or 214b of the switch means 214. The solid-state relay 214a or 214b of the switch means 214 to which the operating signal is input causes the reversible motor 77a to rotate in normal or reverse rotation by switching the reversible motor 77a to the normal rotation or the reverse rotation mode. That is, the operating signal obtained as the photocoupler 212b is driven and the output thereof is output at an H level by the buffer 212d is input into the solid-state relay 214a, switching the reversible motor 77a to the normal rotation mode, causing the reversible motor 77a to rotate in normal rotation. The operating signal obtained as the photocoupler 212c is driven and the output thereof is output at an H level by the buffer 212e is input into the solid-state relay 214b, switching the reversible motor 77a to the reverse rotation mode, causing the reversible motor 77a to rotate in reverse rotation.

The nozzle means movement control device 200 shown in FIG. 1 operates in the aforementioned manner to control the rotation of the reversible motor 77a, and controls the movement of the nozzle means 30 with respect to the roller means 10 via the reversible motor 77a, as will be described in the following. In FIG. 1, the normal rotation of the reversible motor 77a causes the nozzle means 30 to move closer to the roller means 10, while the reverse rotation of the reversible motor 77a causes the nozzle means 30 to move away from the roller means 10.

The rotary encoder 206a of the operating pulse output means 206 is fitted directly or indirectly to a rotary part rotating in synchronism with the plate cylinder PC, or a main drive shaft 113 driven by a main drive source 112, for example, as shown in FIG. 2.

The operation of the dampening device of a printing press having a nozzle means movement control device 200 having the aforementioned construction will be described in the following.

The dampening solution stored in the dampening solution tank 51 is fed to the pipe member 31 via the conduit 52 by the pump 53, with the supply pressure maintained at a predetermined level by the pressure regulator 54.

The dampening solution pressure-fed to the pipe member 31 is injected through the nozzle 32 onto a predetermined area on the outer circumferential surface of the upstream roller 12 of the roller means 10 having a contact area with a printing plate only when the solenoid valve mechanism of the nozzle 32 is kept open.

The remaining dampening solution falling from the outer circumferential surface of the upstream roller 12 is returned from the discharge port on the bottom of the outer cover 82 to the dampening solution tank 51 via a discharge pipe.

As the printing press is operated, that is, as the main drive shaft 113 driven by the plate cylinder PC or the main drive source 112 is rotated, the operating pulse output means 206 outputs pulse signals. When the pulse signals are input into the nozzle operation control means 100, the pulse signals are counted by the nozzle operation control means 100. The nozzle operation control means 100 outputs an excitation signal to the solenoid every time the pulse signal count reaches a predetermined value, and keeps outputting the excitation signals for a preset time in accordance with the pulse signal count in a predetermined time, that is, printing speed.

Then, the solenoid driver applies the excitation signals to the solenoid of the solenoid mechanism of the nozzle 32 in accordance with the aforementioned excitation signals to open the solenoid valve. As a result, the dampening solution is injected under preset conditions onto a corresponding area on the outer circumferential surface of the upstream roller 12.

Since the details of the set values and set time for valve opening control can be determined individually for each nozzle 32 arranged in line on the pipe member 31, the dampening solution can be injected onto each corresponding area on the outer circumferential surface of the upstream roller 12 by changing injecting conditions depending on the ratio and layout of printing areas on the printing plate.

The dampening solution injected through each nozzle 32 is distributed in an oval shape on the outer circumferential surface of the upstream roller 12 due to the shape of the aperture of the nozzle 32, as shown in FIG. 5. The major axes of the dampening solution distributed areas 32a from the nozzles 32 are inclined with respect to the axial line of the upstream roller 12 and virtually parallel with each other. Consequently, both ends each of the dampening solution distributed areas 32a on the outer circumferential surface of the upstream roller 12 can be prevented from overlapping and interfering with each other in the axial direction of the upstream roller 12. At the same time, unwanted changes in the feed rate of dampening solution due to the mutual interference of the injected dampening solution, or an unwanted loss of dampening solution due to changes in the direction of injection can be prevented.

The dampening solution injected on the upstream roller 12 is spread evenly by the rotation of the roller means 10, that is, as the dampening solution passes through the contact area of the upstream and downstream rollers 12 and 11 and transferred onto the downstream roller 11 and then onto the printing plate.

Ink is fed to the printing plate from the ink device IN, and transferred only onto the printing area due to the lipophilic property of the printing area on the printing plate and the mutual repellency of the ink and the dampening solution transferred onto the hydrophilic non-printing area. The ink on the printing area is printed on the web W via the blanket surface of the blanket cylinder BC.

On the other hand, the pulse signals from the operating pulse output means 206 that is operated with the operation of the printing press are input into the data select signal output means 208 in the nozzle means movement control device 200.

The data select signal output means 208 converts the input pulse signals in the F/V converter 208a and the A/D converter 208b, and the CPU 208c calculates the operating speed of the printing press based on the converted signals and outputs data select signals to the analog multiplexer 210a of the nozzle movement signal output means 210 based on the calculation results.

The analog multiplexer 210a selects positive voltage values that correspond to the input data select signals from among the positive voltage values output by the potentiometers 204a, 204b and 204c of the moving position setting means 204 to output as nozzle moving signals to the operating signal output means 212. The positive voltage values in the potentiometers 204a, 204b and 204c of the moving position setting means 204 are set in advance to appropriate levels.

The nozzle moving signals output to the operating signal output means 212 are added to the negative voltage values output as nozzle position signals by the potentiometer 202*a* of the nozzle position signal output means 202 that outputs signals according to the present position of the nozzle means 30, and the sum thereof is input into the operational amplifier 212*a*.

The operational amplifier 212*a* amplifies and outputs the input voltage values to drive the photocoupler 212*b* or 212*c*.

That is, as the operating speed of the printing press is increased to the next step, as described earlier, the data select signal output by the data select signal output means 208 changes, and accordingly the nozzle moving signal selected from among the set voltage values of the moving position setting means 204 by the nozzle moving signal output means 210 also changes.

With this, the voltage value as the sum of the positive voltage value as the nozzle moving signal and the negative voltage value as the nozzle position signal becomes a positive value, changing the output of the operational amplifier 212*a* to a positive voltage value. Thus, the photocoupler 212*b* is driven and the buffer 212*d* turns the output to an H level. This H-level operating signal is input into the solid-state relay 214*a* of the switch means 214.

As the operating signal is input, the solid-state relay 214*a* provided between the motor power source and the reversible motor 77*a* switches the reversible motor 77*a* to the normal rotation mode.

Thus, the reversible motor 77*a* is rotated in the normal direction, causing the one gear shaft 74 on the right side to rotate via the gear 77*c* fitted to the output shaft of the reversible motor 77*a* and the gear 74*b* fitted to the gear shaft 74, and also causing the other gear shaft 74 on the left side to rotate via the gears 77*c* and 74*b*, the gear 75*a* fitted to the one end of the through shaft 75, the through shaft 75, the gear 75*a* fitted to the other end of the through shaft 75, and the gear 74*b* fitted to the other gear shaft 74. Thus, the roller 74*c* is caused to move along the slotted hole 72*c* of the second block member 72 via the offset shaft 74*a* of the gear shaft 74, while the second block member 72 is caused to move in accordance with the movement of the guide member 76 so that the nozzle means 30 fitted to the second block member 72 comes closer to the roller means 10.

As the reversible motor 77*a* is rotated in the normal direction, the operating shaft of the potentiometer 202*a* of the nozzle position signal output means 202 is operated via the gears 77*c* and 202*c*, and the voltage value as the nozzle position signal is changed so that the sum of the nozzle position signal and the nozzle moving signal becomes smaller, and then the voltage value representing the sum eventually becomes zero.

When the sum of the nozzle position signal and the nozzle moving signal becomes zero, the voltage value output by the operational amplifier 212*a* also becomes zero, and as a result, the driving of the photocoupler 212*b* is discontinued and the output of the photocoupler 212*b* is also discontinued. Thus, the operating output via the buffer 212*d* is also discontinued, and the solid-state relay 214*a* turns off the connection between the motor power source and the reversible motor 77*a*. As a result, the nozzle means 30 stops at a predetermined position set by the moving position setting means 204.

As the operating speed of the printing press is decreased to the next step, the data select signal output by the data select signal output means 208 changes, and accordingly the nozzle moving signal selected from among the set voltage values of the moving position setting means 204 by the nozzle moving signal output means 210 also changes.

With this, the voltage value as the sum of the positive voltage value as the nozzle moving signal and the negative voltage value as the nozzle position signal becomes a negative value, changing the output of the operational amplifier 212*a* to a negative voltage value. Thus, the photocoupler 212*c* is driven and the buffer 212*e* turns the output to an H level. This H-level operating signal is input into the solid-state relay 214*b* of the switch means 214.

As the operating signal is input, the solid-state relay 214*b* switches the reversible motor 77*a* to the reverse rotation mode.

Thus, the reversible motor 77*a* is rotated in the reverse direction, causing the one gear shaft 74 on the right side to rotate via the gear 77*c* fitted to the output shaft of the reversible motor 77*a* and the gear 74*b* fitted to the gear shaft 74, and the other gear shaft 74 on the left side to rotate via the gears 77*c* and 74*b*, the gear 75*a* fitted to the one end of the through shaft 75, the through shaft 75, the gear 75*a* fitted to the other end of the through shaft 75, and the gear 74*b* fitted to the other gear shaft 74. Thus, the roller 74*c* is caused to move along the slotted hole 72*c* of the second block member 72 via the offset shaft 74*a* of the gear shaft 74, while the second block member 72 is caused to move in accordance with the movement of the guide member 76 so that the nozzle means 30 fitted to the second block member 72 moves away from the roller means 10.

As the reversible motor 77*a* is rotated in the reverse direction, the operating shaft of the potentiometer 202*a* of the nozzle position signal output means 202 is operated via the gears 77*c* and 202*c*, and the voltage value as the nozzle position signal is changed so that the sum of the nozzle position signal and the nozzle moving signal becomes smaller, and then the voltage value representing the sum eventually becomes zero.

When the sum of the nozzle position signal and the nozzle moving signal becomes zero, the voltage value output by the operational amplifier 212*a* also becomes zero, and as a result, the driving of the photocoupler 212*c* is discontinued and the output of the photocoupler 212*c* is also discontinued. Thus, the operating output via the buffer 212*e* is also discontinued, and the solid-state relay 214*b* turns off the connection between the motor power source and the reversible motor 77*a*. As a result, the nozzle means 30 stops at a predetermined position set by the moving position setting means 204.

As described above, the nozzle means 30 is controlled by the nozzle means movement control device 200 to move to a predetermined position and stop at that position so that the injection hole of the nozzle 32 can be moved closer to or away from the outer circumferential surface of the upstream roller 12 of the roller means 10 every time the operating speed of the printing press rises above or falls below a predetermined range.

As a result, the size L of the axially overlapped area of the distributed area 32*a* of the dampening solution injected through the adjoining nozzles 32 on the outer circumferential surface of the upstream roller 12 can be set and adjusted to an appropriate range.

This invention is not limited to the aforementioned embodiments. The reversible motor 77*a* may be a reversible motor with reduction gear, with the gear 77*c* fitted to the output shaft of the reduction gear. Furthermore, the number of potentiometers in the moving position setting means 204 of the nozzle means 30 may be increased or reduced, or the nozzle means 30 may be moved close to or away from the roller means 10 by increasing or reducing, or finely or roughly adjusting the number of positions to which the nozzle means 30 is moved and stopped, depending on the operating speed of the printing press.

As described above, this invention makes it possible to change the distance between the nozzles injecting the dampening solution and the solution receiving roller to which the dampening solution is injected in accordance with a predetermined range of the operating speed of the printing press, and automatically change the size of the axially overlapped areas of the dampening solution injected through the adjoining nozzles on the circumferential surface of the solution receiving roller.

Consequently, inconveniences resulting from the excess application of dampening solution due to the axially overlapped areas of the dampening solution on the solution receiving roller as the operating speed of the printing press increases can be eliminated.

This invention makes it possible to stably stop the nozzles at predetermined positions without causing unwanted hunting in nozzle movement since the distance between the nozzles and the solution receiving roller can be changed for each predetermined range of the operating speed of the printing press.

What is claimed is:

1. An apparatus for controlling nozzle movement in nozzle-type dampening systems for a planographic printing press including a plate cylinder with a printing plate, the apparatus comprising a roller means having a roller, a nozzle means in which a plurality of nozzles facing said roller means along an axial line of said roller can be moved en bloc close to and away from said roller means, and a nozzle moving means for moving said nozzle means close to and away from said roller means; dampening solution injected through said nozzle means is fed over the surface of said roller characterized in that said apparatus for controlling nozzle movement comprises a motor for driving said nozzle moving means to cause said nozzle means to move, a nozzle position signal output means for outputting the present position of said nozzle means moved by said motor with respect to a predetermined reference position, a moving position setting means for setting in advance moving positions to which said nozzle means is to be moved, an operating pulse output means for outputting pulse signals in synchronism with the rotation of said plate cylinder of the printing press, a data select signal output means for detecting the operating speed of said printing press from pulse signals output by said operating pulse output means and outputting data select signals in accordance with said detected operating speed, a nozzle movement signal output means for generating a nozzle moving signal selecting a moving position to which said nozzle means is to be moved from among moving positions set in said moving position setting means, and an operating signal output means for producing a motor operating signal based on said nozzle moving signal generated by said nozzle moving signal output means and an output of the present position of said nozzle means output by said nozzle position signal output means.

2. An apparatus for controlling nozzle movement in nozzle-type dampening systems as claimed in claim 1 wherein: said nozzles include valves, and preset conditions for opening said valves of said nozzles are set for each of said nozzles based on at least a ratio and layout of printing areas on said printing plate.

3. An apparatus for controlling nozzle movement in nozzle-type dampening systems as claimed in claim 2 wherein: each of said nozzles include a valve, and time for opening said valve for each nozzle is determined in accordance with said preset conditions and in accordance with the operating speed of said printing press.

4. An apparatus for controlling nozzle movement in nozzle-type dampening systems as claimed in claim 1 wherein said moving position setting means has such a construction that a plurality of preset values representing positions to which said nozzle means is to be moved are preset in accordance with the operating speed of said printing press are output; and said data select signal output means selects one of said preset values based on a data select signal in accordance with the operating speed of said printing press.

5. An apparatus for controlling nozzle movement in nozzle-type dampening systems as claimed in claim 1 wherein each of said nozzles disposed facing said roller means along the axial line feeds dampening solution in an oval pattern onto said roller means, and the major axes of oval dampening solution distributed areas injected by said nozzles are inclined with respect to the axial line of said roller means and parallel with each other.

6. An apparatus for controlling nozzle movement in nozzle-type dampening systems as claimed in claim 5, wherein the major axes of said oval dampening solution distributed areas injected by said nozzles are inclined with respect to the axial line of said roller means, and the oval dampening solution distributed areas injected from adjoining nozzles are partially overlapped at positions in the axial direction of said roller means.

7. An apparatus for controlling nozzle movement in nozzle-type dampening systems as claimed in claim 6 wherein the width of said overlapped oval dampening solution distributed areas is controlled in accordance with the movement of said nozzle moving means.

* * * * *